US007647859B2

(12) United States Patent
Theodore, Jr.

(10) Patent No.: US 7,647,859 B2
(45) Date of Patent: Jan. 19, 2010

(54) SWASH RING COMPRESSOR

(75) Inventor: Michael Gregory Theodore, Jr., Plymouth, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 12/263,935

(22) Filed: Nov. 3, 2008

(65) Prior Publication Data

US 2009/0060757 A1 Mar. 5, 2009

Related U.S. Application Data

(63) Continuation of application No. 11/497,116, filed on Aug. 1, 2006, now Pat. No. 7,444,921.

(51) Int. Cl.
*F04B 27/16* (2006.01)
*F04B 27/10* (2006.01)

(52) U.S. Cl. ..... 92/12.2; 417/222.2

(58) Field of Classification Search ..... 92/12.2, 92/71; 91/499; 417/222.2, 269
See application file for complete search history.

(56) References Cited

U.S. PATENT DOCUMENTS

| | | | |
|---|---|---|---|
| 4,178,135 | A | 12/1979 | Roberts |
| 4,294,139 | A | 10/1981 | Bex et al. |
| 4,553,905 | A | 11/1985 | Swain et al. |
| 5,304,042 | A | 4/1994 | Kayukawa et al. |
| 5,336,056 | A | 8/1994 | Kimura et al. |
| 5,364,232 | A | 11/1994 | Kimura et al. |
| 5,644,968 | A | 7/1997 | Kimura et al. |
| 5,785,503 | A | 7/1998 | Ota et al. |
| 5,836,748 | A | 11/1998 | Kawaguchi et al. |
| 5,865,604 | A | 2/1999 | Kawaguchi et al. |
| 5,974,946 | A | 11/1999 | Kanou et al. |
| 6,164,252 | A | 12/2000 | Kuhn et al. |
| 6,474,955 | B1 | 11/2002 | Ota et al. |
| 6,511,296 | B2 | 1/2003 | Ota et al. |
| 6,589,022 | B2 | 7/2003 | Yokomachi et al. |
| 6,629,823 | B2 | 10/2003 | Ota et al. |
| 6,705,841 | B2 | 3/2004 | Pawelski et al. |

(Continued)

FOREIGN PATENT DOCUMENTS

| | | | |
|---|---|---|---|
| EP | 0 844 390 | B1 | 8/1999 |

(Continued)

*Primary Examiner*—Thomas E Lazo
(74) *Attorney, Agent, or Firm*—Fraser Clemens Martin & Miller LLC; J. Douglas Miller

(57) ABSTRACT

A variable displacement compressor is disclosed. The compressor includes a crankcase for receiving a fluid. The crankcase has a plurality of compression chambers in which the fluid is compressed. A plurality of pistons disposed within the crankcase and are configured for reciprocal movement within the plurality of chambers to compress and pump the fluid. Further, a rotor assembly having a drive shaft and a rotor, wherein the rotor has a first pivot arm support member extending from a first surface of the rotor. A sleeve is slidably engaged with the drive shaft and configured for axial movement along a longitudinal axis of the drive shaft. A swash ring is coupled to the plurality of pistons and to the rotor by means of a pivot arm. Rotary motion of the swash ring and rotor causes reciprocal motion of the plurality of pistons within the plurality of chambers.

17 Claims, 9 Drawing Sheets

U.S. PATENT DOCUMENTS

| | | | |
|---|---|---|---|
| 6,928,919 | B2 | 8/2005 | Parsch |
| 6,932,582 | B2 | 8/2005 | Hayashi et al. |
| 7,144,227 | B2 | 12/2006 | Casar et al. |
| 7,444,921 | B2 | 11/2008 | Theodore, Jr. |
| 2004/0007126 | A1 | 1/2004 | Parsch |
| 2004/0216603 | A1 | 11/2004 | Scharzkopf |
| 2008/0028926 | A1 | 2/2008 | Theodore |
| 2008/0223208 | A1 | 9/2008 | Lee et al. |

FOREIGN PATENT DOCUMENTS

| | | | |
|---|---|---|---|
| EP | 1 043 500 | A2 | 10/2000 |
| JP | 2003-120525 | A | 4/2003 |
| JP | 2003-269330 | A | 9/2003 |
| WO | WO 99/24715 | | 5/1999 |
| WO | WO 01/65071 | A2 | 9/2001 |
| WO | WO 2004/111451 | A1 | 12/2004 |
| WO | WO 2005/021967 | A1 | 3/2005 |
| WO | WO 2005/035981 | A1 | 4/2005 |
| WO | WO 2005/035982 | A1 | 4/2005 |
| WO | WO 2005/038253 | A1 | 4/2005 |
| WO | WO 2005/047697 | A1 | 5/2005 |
| WO | WO 2005/050016 | A1 | 6/2005 |

SWASH RING COMPRESSOR

CROSS-REFERENCE TO RELATED APPLICATION

This application is a continuation of U.S. patent application Ser. No. 11/497,116 filed on Aug. 1, 2006, hereby incorporated herein by reference in its entirety.

TECHNICAL FIELD

The present invention relates to variable displacement compressors having an adjustable swash ring for changing the displacement of the compressor.

BACKGROUND OF THE INVENTION

Variable displacement compressors having a swash ring are well known in the art. Such compressors typically include a plurality of pistons that are driven by the swash ring. The swash ring is operatively coupled to a drive shaft and rotor assembly. The swash ring is angled or inclined relative to the rotor to change the total displacement of the compressor. One well known design includes a pivot pin that is fixed at one end to the drive shaft and pivotally connected to the swash ring at the other end.

Conventional swash ring compressors rely on a sphere to contact the inside of the swash ring supporting the load. Although this design works when the swash ring is made from a hard material, a swash ring made from soft alloys is preferred for improved seizure resistance. To allow a swash ring compressor to use a soft alloy for the swash ring, the load must be distributed over a larger area, which reduces the contact pressure.

While this design achieves its intended purpose many problems still exist. For example, because the pivot pin is located in the drive shaft, the drive shaft must be thicker or larger in diameter resulting in a higher design cost. Moreover, since the swash ring is limited by the pin thickness the compressor will have a large diameter but a poor volumetric efficiency. Further, prior art designs are unable to maintain a constant TDC without holding extremely tight positional tolerances. Further, inserting the pivot pin into the drive shaft at an angle requires expensive gauging. Since a single pivot pin carries the entire load, the pivot pin needs to be made of very expensive heat treated special steels. In addition, designs that include a single pin at a specified angle are not bidirectional thus, clockwise and anticlockwise models must be produced. This of course adds cost and manufacturing complexity. The design further has no provision for a counterweight balancing mass and lacks room for packaging such a mass to offset the pivot pin structure.

For these reasons and others a new and improved swash ring compressor is needed. Such a compressor is herein described below.

BRIEF SUMMARY OF THE INVENTION

In an aspect of the present invention, a variable displacement compressor is provided. The compressor includes a crankcase for receiving a fluid. The crankcase has a plurality of compression chambers in which the fluid is compressed. A plurality of pistons are disposed within the crankcase and configured for reciprocal movement within the plurality of chambers to compress and pump the fluid.

The compressor may further include a pivot pin projecting from the drive shaft with a sleeve disposed over the spherical end of the pivot pin. The sleeve being pivotably arranged about the spherical end of the pivot pin and slidably engaged within a swash ring. The compressor may further include a rotor assembly having a drive shaft and a rotor wherein the rotor has a first pivot arm support member extending from a first surface of the rotor; a sleeve slidably engaged to the drive shaft and configured for axial movement along a longitudinal axis of the drive shaft. The swash ring is coupled to the plurality of pistons and through rotary motion of the swash ring causes reciprocal motion of the plurality of pistons within the plurality of chambers, and wherein the swash ring is connected to the rotor by a first pivot arm pivotally connected to a swash ring at a first end and to the first pivot support member at a second end, and wherein the swash ring is pivotally mounted to the sleeve, whereby axial movement of the sleeve along the longitudinal axis of the drive shaft causes the swash ring to tilt relative to the rotor.

In yet another aspect of the present invention, the compressor includes a spring disposed around the drive shaft for biasing the swash ring away from the rotor.

In yet another aspect of the present invention, the compressor includes a counterweight member extending from the first surface of the rotor to counter balance the centrifugal forces created by the rotation of the swash ring.

In still another aspect of the present invention, the counterweight member extending from the first surface of the rotor is disposed opposite the pivot arm support member.

In still another aspect of the present invention, the counterweight member extending from the first surface of the rotor and is disposed inward of the swash ring.

In yet another aspect of the present invention, the compressor includes a thrust bearing to provide axial movement of the swash ring along the drive shaft toward the rotor.

In yet another aspect of the present invention, the compressor includes a swash ring stop member extending from the first surface of the rotor to prevent angular rotation of the swash ring past a predefined angle.

In still another aspect of the present invention, the first end of the first pivot arm is spherically shaped.

In still another aspect of the present invention, the second end of the first pivot arm is cylindrically shaped.

In yet another aspect of the present invention, the compressor includes an insert sleeve press fitted into a bore in the swash ring for receiving the first end of the first pivot arm.

In yet another aspect of the present invention, a variable displacement compressor is provided. The compressor includes a crankcase for receiving a fluid, wherein the crankcase has a plurality of compression chambers in which the fluid is compressed. Further, a plurality of pistons are disposed within the crankcase and configured for reciprocal movement within the plurality of chambers to compress and pump the fluid. A rotor assembly is further provided having a drive shaft and a rotor. The rotor has a pivot arm support member extending from a first surface of the rotor. A sleeve is slidably engaged to the drive shaft and configured for axial movement along a longitudinal axis of the drive shaft. A swash ring is coupled to the plurality of pistons and through rotary motion of the swash ring causes reciprocal motion of the plurality of pistons within the plurality of chambers. The swash ring is connected to the rotor by a pair of pivot arms pivotally connected to the swash ring at a first end and to the pivot support member at a second end. Further, the swash ring is pivotally mounted to the sleeve, whereby axial movement of the sleeve along the longitudinal axis of the drive shaft causes the swash ring to tilt relative to the rotor.

The compressor may further contain a rotor assembly having a drive shaft and a rotor, wherein the rotor has a first pivot arm support member extending from a first surface of the rotor; a sleeve slidably engaged to the drive shaft and configured for axial movement along a longitudinal axis of the drive shaft; and a swash ring coupled to the plurality of pistons and through rotary motion of the swash ring causes reciprocal motion of the plurality of pistons within the plurality of chambers. Wherein the swash ring is connected to the rotor by a first pivot arm pivotally connected to the swash ring at a first end and to the first pivot support member at a second end, and wherein the swash ring is pivotally mounted to the sleeve, whereby axial movement of the sleeve along the longitudinal axis of the drive shaft causes the swash ring to tilt relative to the rotor.

In yet another aspect of the present invention, the compressor includes a second pivot arm for connecting the swash ring to the rotor.

In yet another aspect of the present invention, the compressor includes a second pivot arm support member fixed to the rotor for supporting the second pivot arm.

In yet another aspect of the present invention, a variable displacement compressor is provided. The compressor includes a crankcase for receiving a fluid, wherein the crankcase has a plurality of compression chambers in which the fluid is compressed. Further, a plurality of pistons are disposed within the crankcase and configured for reciprocal movement within the plurality of chambers to compress and pump the fluid. A rotor assembly is further provided having a drive shaft and a rotor. The rotor has a pivot arm support member extending from a first surface of the rotor. A sleeve is slidably engaged to the drive shaft and configured for axial movement along a longitudinal axis of the drive shaft. A swash ring is coupled to the plurality of pistons and through rotary motion of the swash ring causes reciprocal motion of the plurality of pistons within the plurality of chambers. The swash ring is connected to the rotor by a pair of pivot arms pivotally connected to the swash ring at a first end and to the pivot support member at a second end. Further, the swash ring is pivotally mounted to the sleeve, whereby axial movement of the sleeve along the longitudinal axis of the drive shaft causes the swash ring to tilt relative to the rotor.

DETAILED DESCRIPTION OF THE INVENTION

Figure 1:
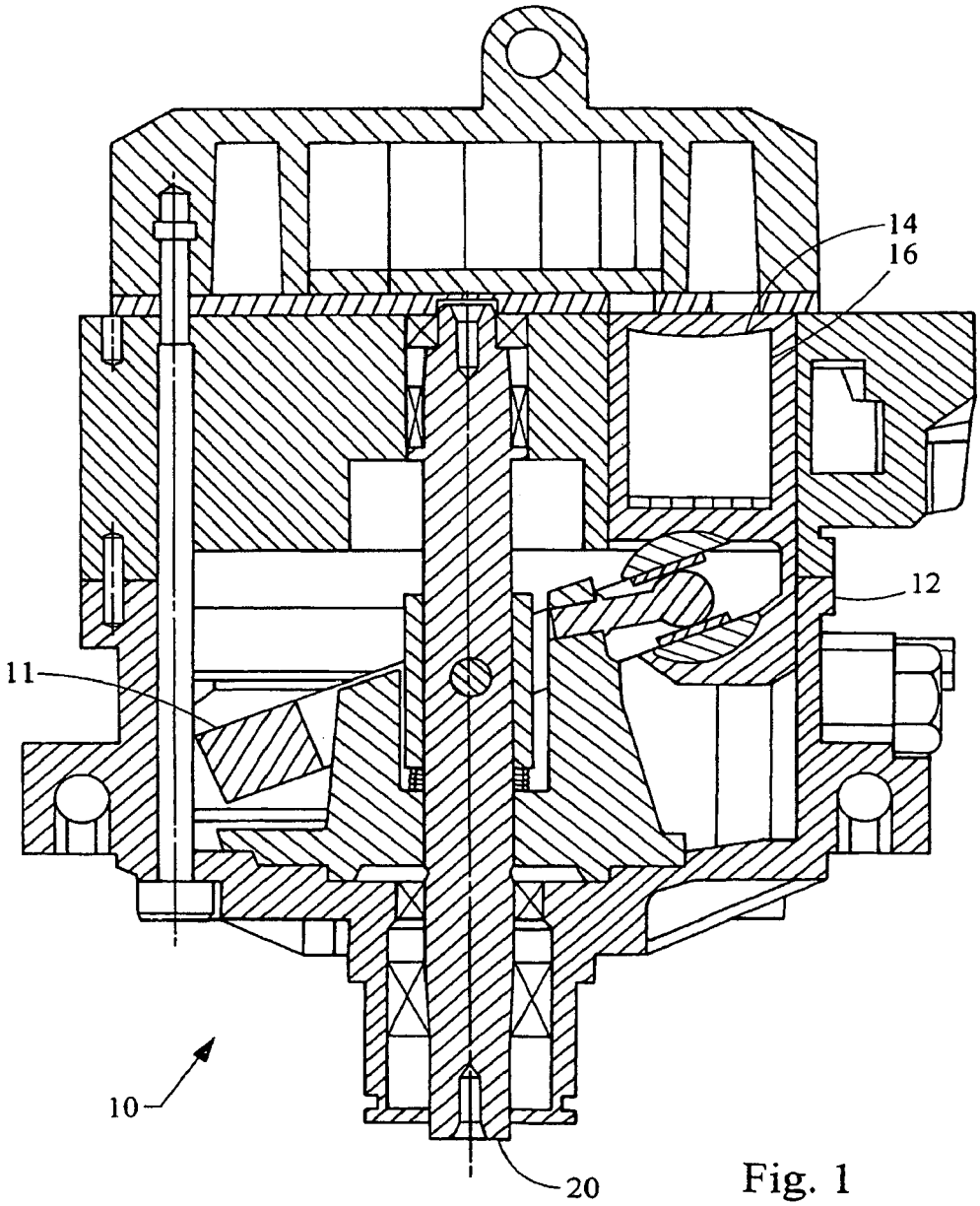
FIG. 1 is a perspective view of a variable displacement swash ring type compressor, in accordance with an embodiment of the present invention.

Referring now to FIG. 1 a variable displacement compressor 10 is illustrated, in accordance with an embodiment of the present invention. Compressor 10 is referred to as a variable displacement compressor because the total displacement of the refrigerant pumping capacity may be adjusted by changing the inclination of a swash ring 11, which will be described in further detail below. Variable displacement compressor 10 includes a crankcase 12 that has a plurality of chambers 14 configured to cooperate with a plurality of pistons 16. Pistons 16 are operatively coupled to a swash ring 11 to cause reciprocal movement of pistons 16 within chambers 14. Compressor 10 further includes a rotor assembly 20 having a rotor 22 rotationally fixed to a drive shaft 24. Rotor assembly 20 imparts a rotational force to swash ring 11 to cause rotary movement of the swash ring. Typically, drive shaft 24 will have a pulley (not shown) mounted to one of its ends. A serpentine belt driven by an engine of an automotive vehicle engages the pulley and rotationally drives the pulley, although, the concepts of the present invention will be realized on a compressor where the drive shaft is driven by other means.

Figure 2:
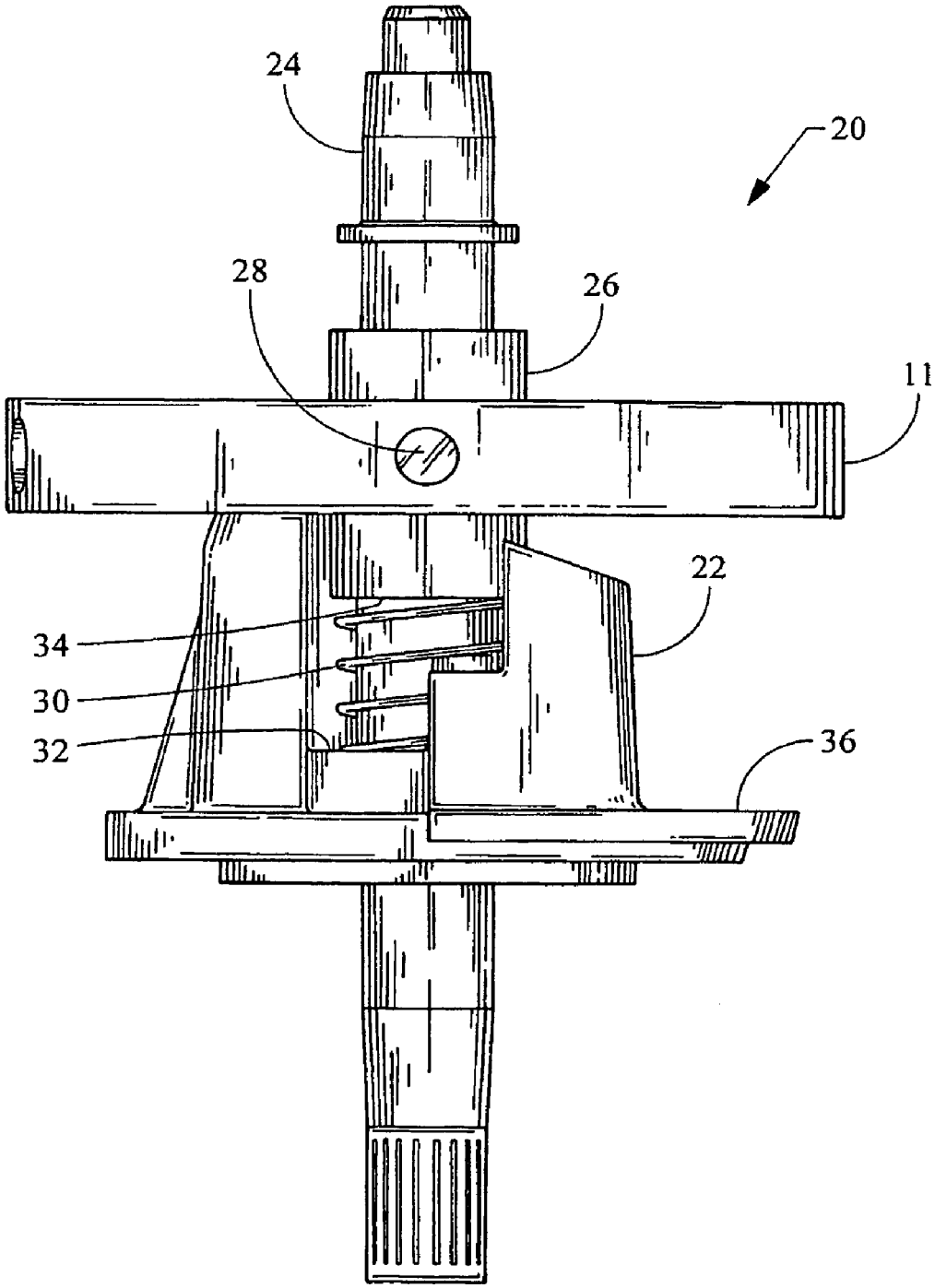
FIG. 2 is a side perspective view of the swash ring and rotor assembly of the variable displacement compressor shown in FIG. 1, wherein the swash ring is shown in a minimum displacement position, in accordance with an embodiment of the present invention.

Referring to FIG. 2, swash ring 11 and rotor assembly 20 are illustrated in further detail, in accordance with an embodiment of the present invention. Swash ring 11 is shown in a plane that is parallel with the base 36 of rotor 22. When swash ring 11 is in the position shown in FIG. 2, compressor 10 is at its minimum displacement. Rotor assembly 20 further includes a sleeve 26. Sleeve 26 is operatively configured to slide axially along drive shaft 24. Swash ring 11 is pivotably secured to sleeve 26 through a plurality of pivot pins 28. While only one pivot pin 28 is illustrated, it should be understood that a similarly configured pivot pin (not shown) is disposed on the opposite side of drive shaft 24. Pivot pins 28 are axially aligned with one another and extend radially outward from diametrically opposed sides of sleeve 26. The pivot pins 28 pivotally engage the swash ring 11 to allow the swash ring to pivot about an axis running longitudinally through pivot pins 28 and through driveshaft 24.

Further, swash ring 11 is pivotally mounted to rotor 22 to allow the swash ring to rotate relative to rotor 22, as will be described in greater detail below. The angle of inclination of swash ring 11 relative to rotor 11 increases as sleeve 26 approaches rotor 22. Swash ring 11 is biased away from rotor 22 by a biasing spring 30 disposed around drive shaft 24. More specifically, spring 30 contacts rotor 22 at a first end 32 and sleeve 26 at a second end 34. As sleeve 26 moves closer to rotor 22 spring 30 compresses. Conversely, as sleeve 26 moves away from rotor 22 spring 30 expands in length.

Figure 3:
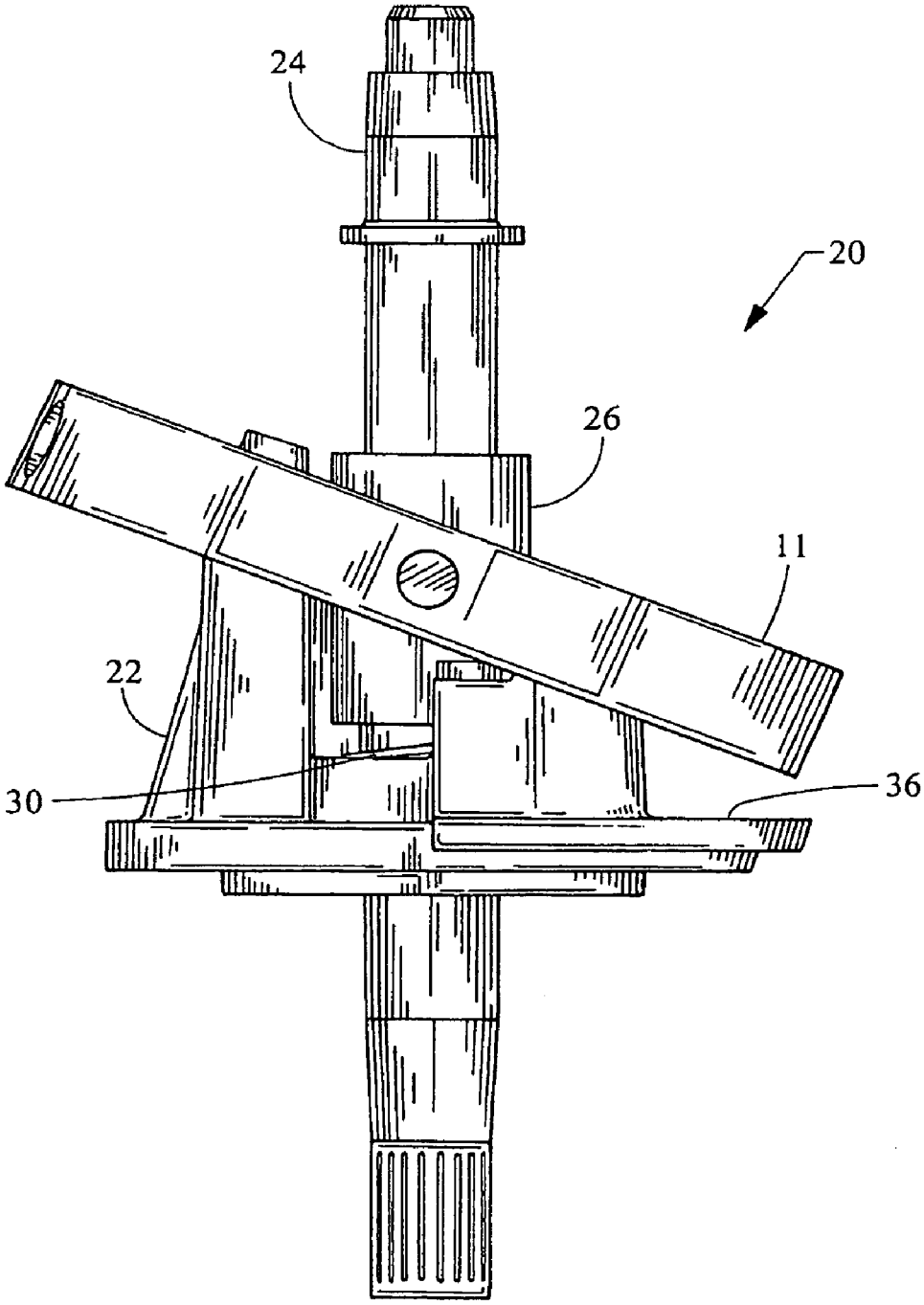
FIG. 3 is a side perspective view of the swash ring and rotor assembly of the variable displacement compressor, wherein the swash ring is shown in a maximum displacement position, in accordance with an embodiment of the present invention.

Referring now to FIG. 3, a perspective view of swash ring 11 and rotor assembly 20 is illustrated, in accordance with an embodiment of the present invention. Swash ring 11 is shown in an inclined position relative to the rotor base 36. The inclination of swash ring 11 is provided by the axial sliding movement of sleeve 26 along drive shaft 24 in a direction that compresses spring 30.

Figure 4:
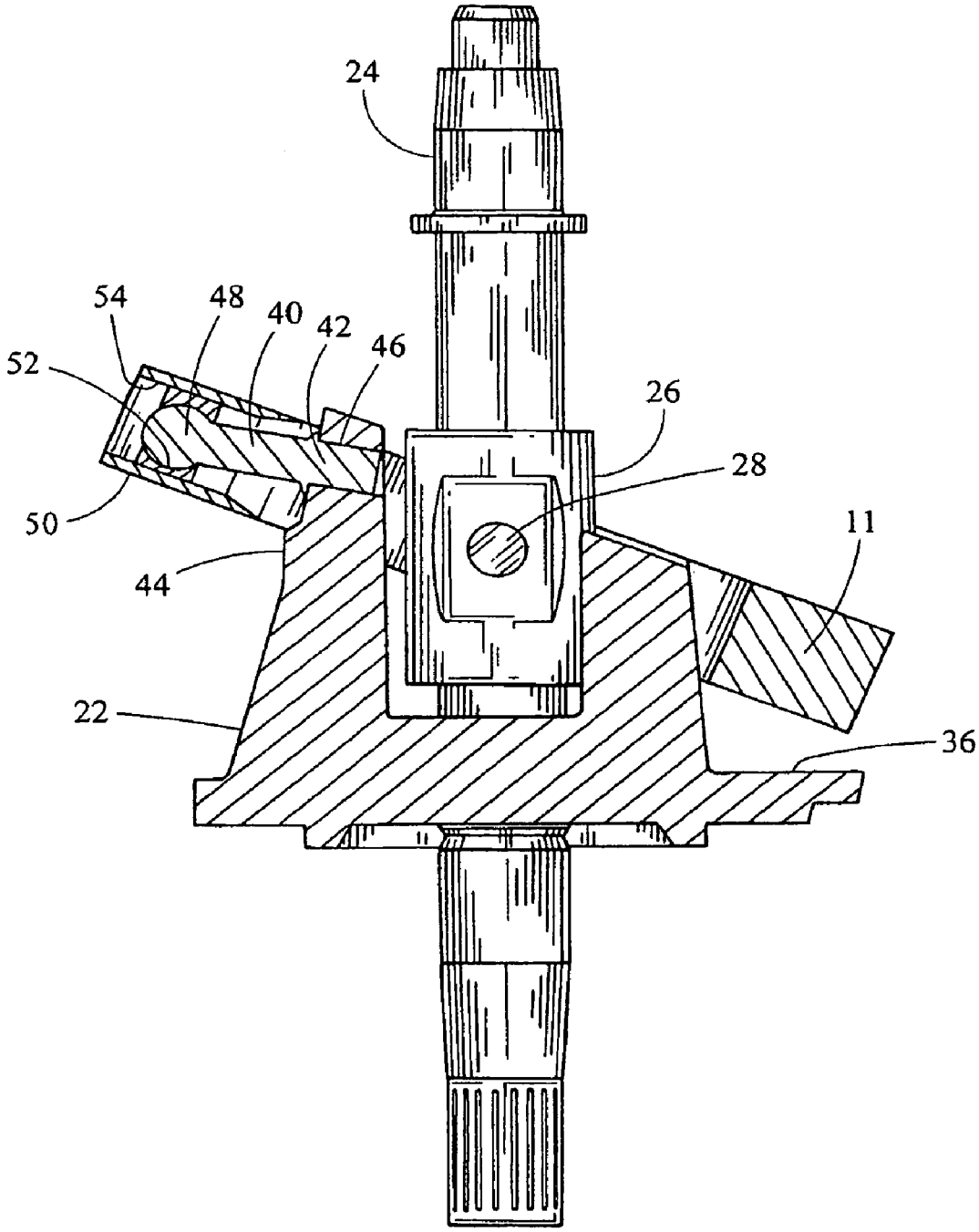
FIG. 4 is a cross-sectional view through the swash ring and rotor assembly of the variable displacement compressor, wherein the swash ring is shown in a maximum displacement position, in accordance with an embodiment of the present invention.
Figure 5:
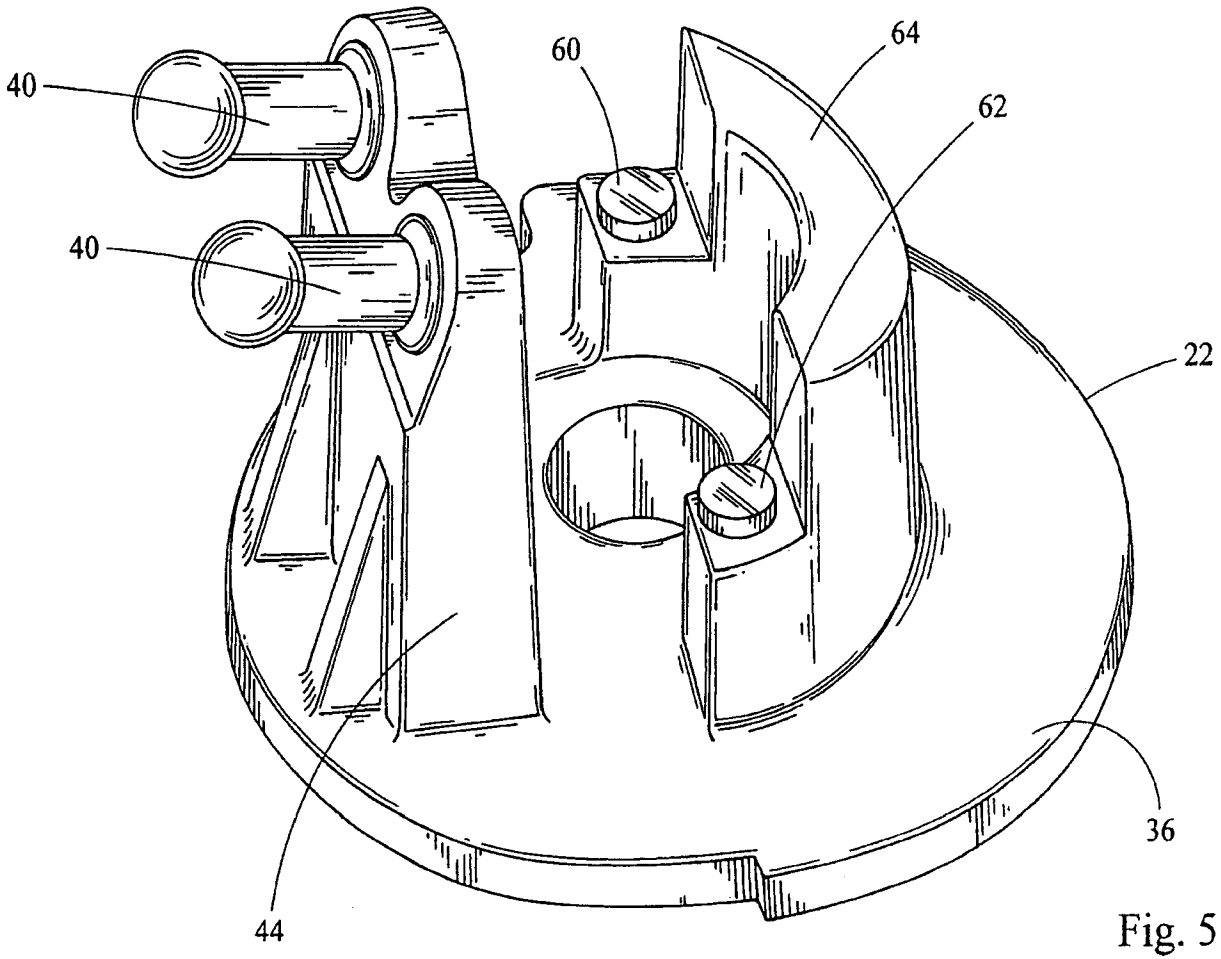
FIG. 5 is a perspective view of the rotor of the rotor assembly, in accordance with an embodiment of the present invention.

Referring now to FIG. 4, the attachment of swash ring 11 to rotor assembly 20 is further illustrated in a cross-sectional view as indicated in FIG. 3, in accordance with an embodiment of the present invention. Swash ring 11 is mounted to rotor 22 by a pair of pins 40 disposed adjacent on another (as shown in FIG. 5). Each pin 40 is secured or press fitted into bores 42 disposed in a pin support member 44 at a first end 46 of each pin 40. Pin support member 44 is preferably integrally formed and extends from base 36 of rotor 22. Each pin 40 is slidably and pivotably coupled to swash ring 11 at opposing ends 48. More specifically, each opposing end 48 is preferably spherical and is fitted into a collar or guide bushing 50 having spherical sidewalls 52 that cooperatively mate with spherical surfaces of end 48. Each collar bushing 50 is configured to slide within a bore 54 of swash ring 11. In operation, as sleeve 26 slides away from rotor 22 causing swash ring 11 to move toward a plane that is parallel to base 36 of rotor 22, as shown in FIG. 2, swash ring 11 moves over each collar bushing 50. In this manner, swash ring 11 is allowed to move between an inclined plane and a plane that is parallel with base 36 of rotor 22.

Referring now to FIG. 5, rotor 22 is illustrated in further detail, in accordance with an embodiment of the present invention. As previously stated, rotor 22 includes a pin support member 44 that extends from base 36 of rotor 22. Support member 44 supports pins 40 at a predefined angle. While two support pins 40 are illustrated, the present invention contemplates the use of one pin as well as more than two pins to support swash ring 11. Rotor 22 further includes a pair of sleeve stops 60 and 62. Sleeve stops prevent further movement of sleeve 26 toward rotor 22. When sleeve 26 is stopped by sleeve stops 60 and 62, the variable displacement compressor is in a maximum displacement configuration. Rotor 22 further includes a counterweight structure 64. Counterweight structure 64 is a mass of material (i.e., metal) that extends from the base 36 of rotor 22. Counterweight 64 counters the centrifugal forces generated by the rotation of rotor 22 and the mass making up support pin structure 44. Effectively, counterweight 64 balances out the centrifugal forces generated by the rotation of pin support structure 44.

Figure 6:
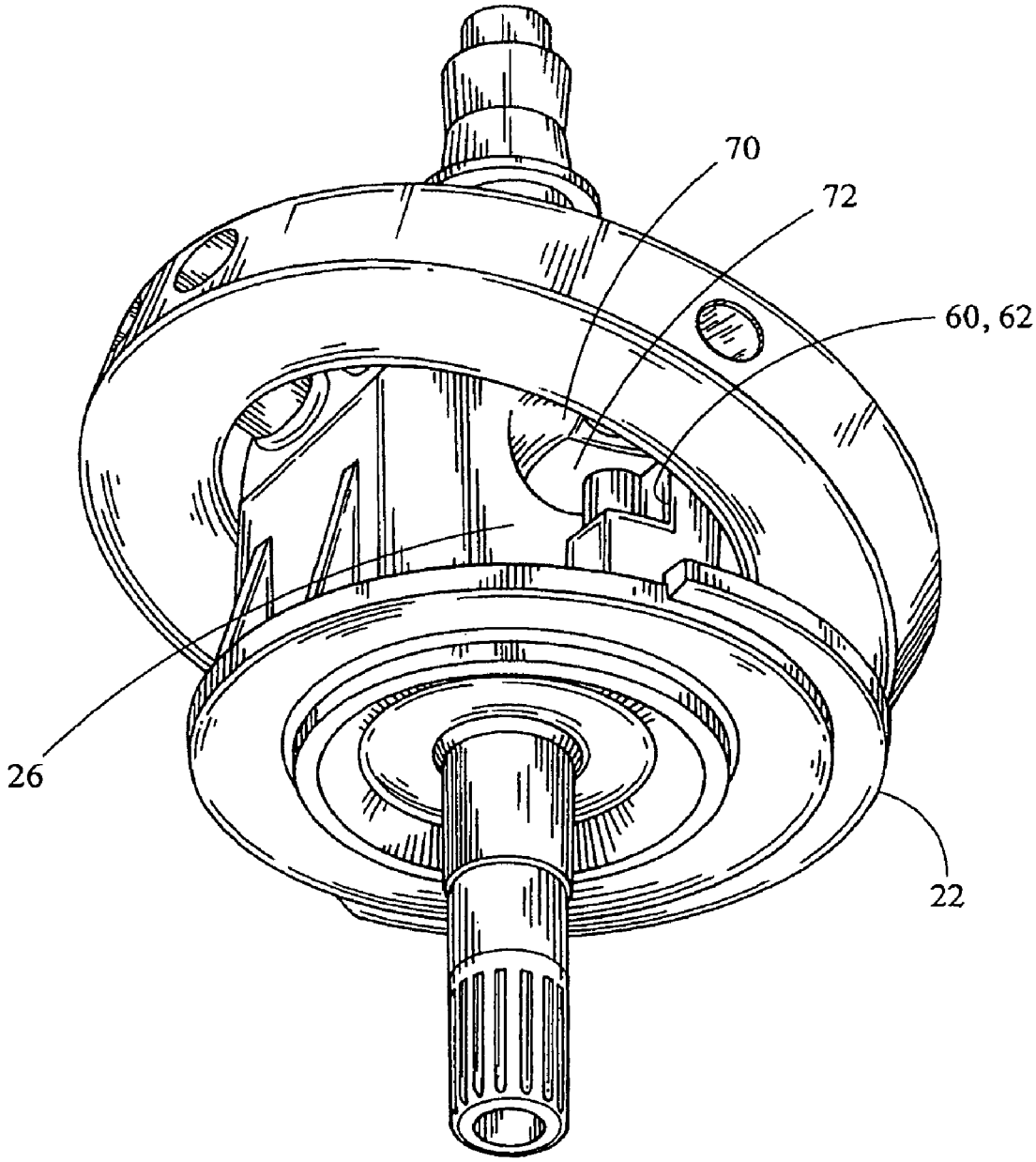
FIG. 6 is a perspective view of a swash ring and the rotor assembly, in accordance with an embodiment of the present invention.

Referring now to FIG. 6, a perspective view of swash ring 11 and rotor assembly 20 is shown, in accordance with an embodiment of the present invention. Swash ring 11 is at an inclination that causes the maximum displacement of refrigerant. At maximum displacement, sleeve stops 60 and 62 are shown in contact with an arm 70 integrally formed in and extending from sleeve 26. This configuration allows sleeve 26 to move toward rotor 22 and compressing spring 30 until the surface 72 of arm 70 contacts sleeve stop 60 or 62. Of course, the present invention contemplates the use of only one sleeve stop instead of two.

Figure 7:
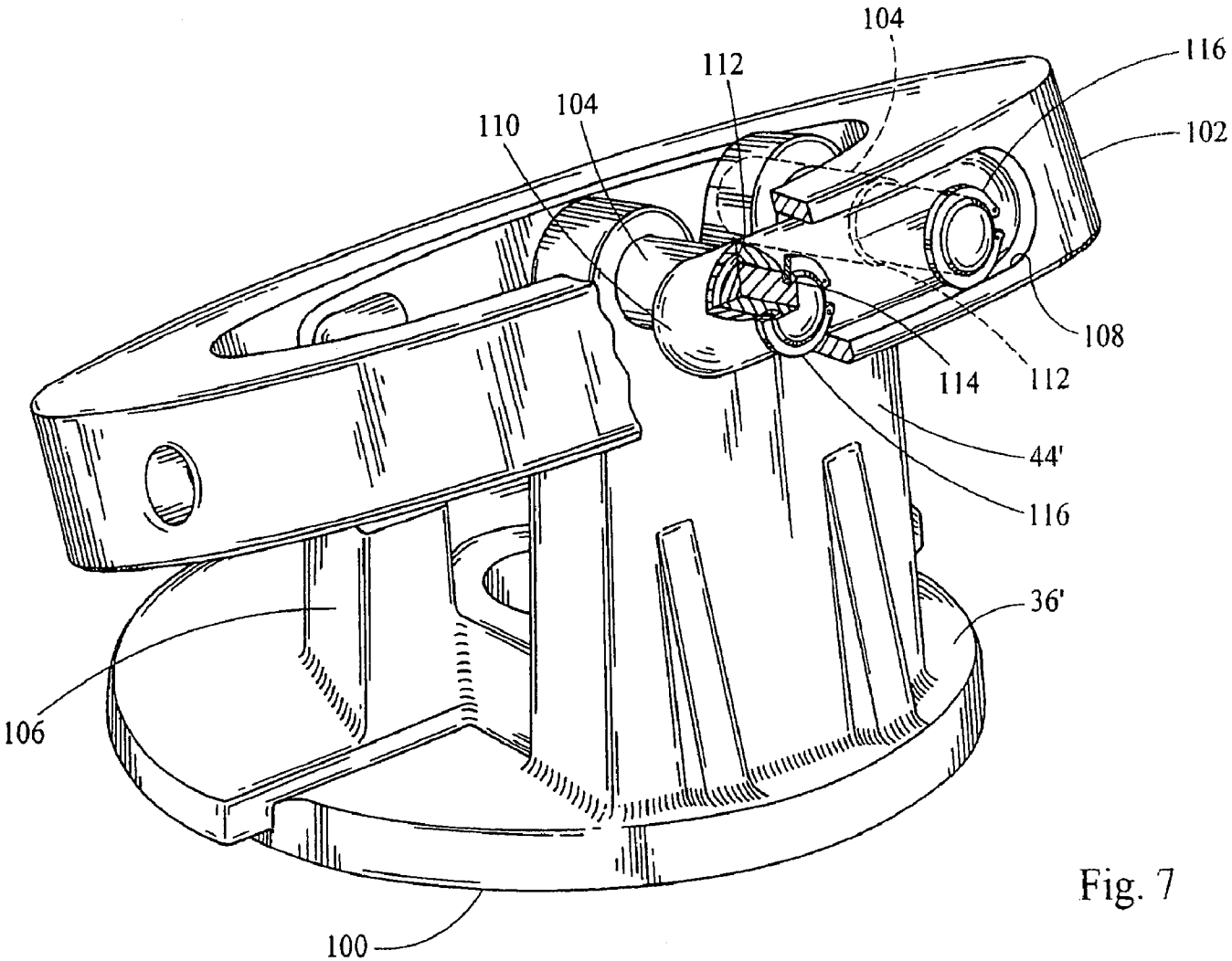
FIG. 7 is a perspective view of an alternate embodiment of a rotor and swash ring, in accordance with the present invention.

Referring now to FIG. 7, a perspective view of an alternate embodiment of a rotor 100 and swash ring 102 are illustrated, in accordance with another embodiment of the present invention. As in rotor 22 described above, rotor 100 includes a pin support member 44' that extends from base 36' of rotor 100. Support member 44' supports a pair of pins 104 at a predefined angle. While two support pins 104 are illustrated, of course, the present invention contemplates the use of one pin as well as more than two pins to support swash ring 102. Rotor 100 further includes a pair of sleeve stops 106 (one shown). Sleeve stops are configured and operate in the same manner as previously described with reference to rotor 22 shown in FIG. 5, that is to prevent further movement of sleeve 26 (shown in FIG. 2) toward rotor 100. Rotor 100 further includes a counterweight structure (not shown) having the same configuration as described and illustrated above with respect to rotor 22 (shown in FIG. 5).

With continuing reference to FIG. 7, the attachment of swash ring 102 to rotor 100 will now be described. Swash ring 102 includes an elongated aperture 108 that extends through swash ring 102. A tube bushing 110 is disposed in elongated aperture 108. Elongated aperture 108 is configured such that the outer surfaces of tube bushing 110 contact the inside surface of aperture 108 and allows swash ring 102 to rotate relative to tube bushing 110. Support pins 104 are substantially straight pins with a step 112 to prevent tube bushing 110 from sliding towards support member 44'. Further, support pins 104 include an annular groove 114 for lockably receiving a c-clamp 116 or similar device to secure tube bushing 110 to support pins 104. This configuration provides an efficient means to rotatably attach the swash ring to the rotor.

Figure 8:
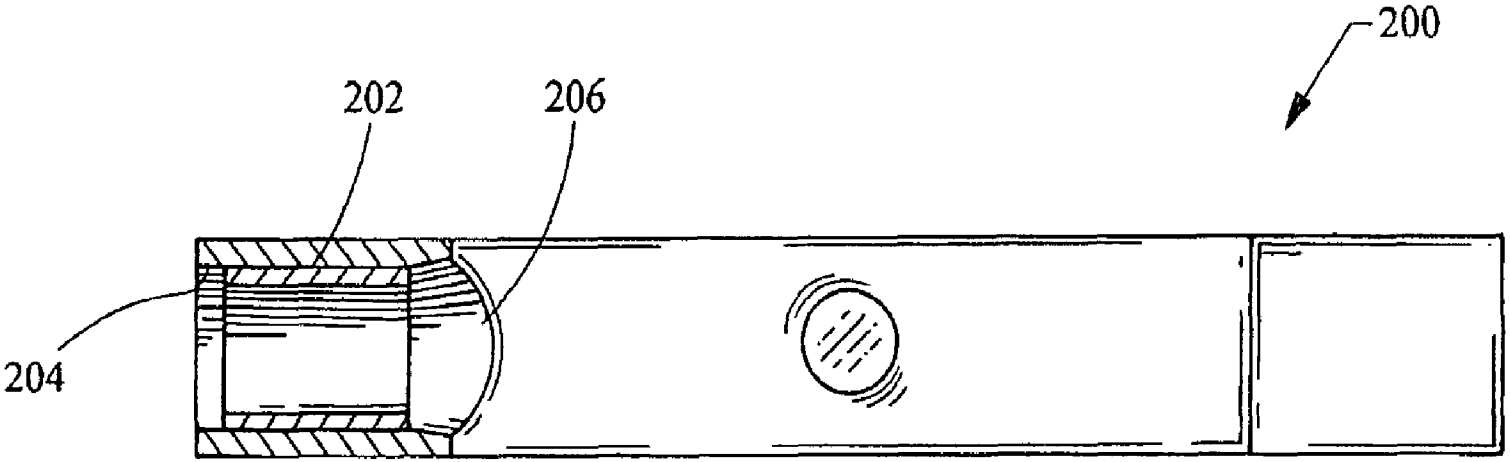
FIG. 8 is a cross-sectional view of an alternate swash ring, in accordance with an alternate embodiment of the present invention.

Referring now to FIG. 8, a cross-sectional view of an alternate swash ring 200 is illustrated in accordance with an alternate embodiment of the present invention. As shown in FIG. 8, swash ring 200 includes a support sleeve 202. Support sleeve 202 is press fitted into a bore 204 in swash ring 200. A pin (not shown) similar to pin 40 having a spherical end 48, as shown in FIG. 4, is configured to support swash ring 200 around drive shaft 24. In operation, the spherical end 48 of pin 40 slides along the inside surface of support sleeve 202. A flared end 206 of bore 204 allows the swash ring to tilt with out interfering with pin 40. Support sleeve 202 operates to distribute the load on pin 40 over a larger surface area of the swash ring 200.

Figure 9:
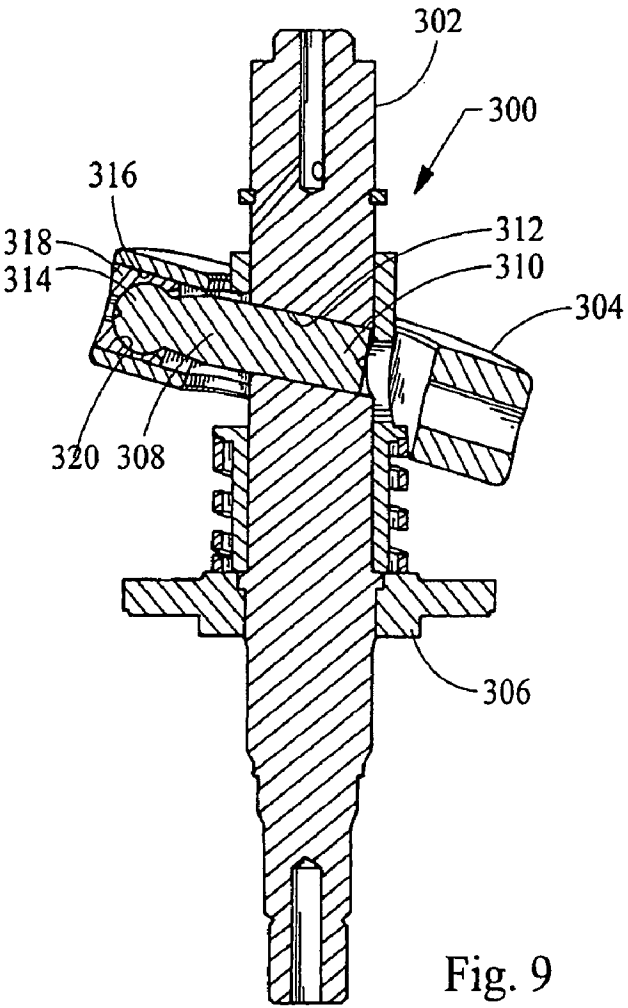
FIG. 9 is a cross-sectional view of an alternate embodiment of a swash ring and rotor, in accordance with an alternate embodiment of the present invention.

Referring now to FIG. 9, a cross-sectional view of an alternate embodiment of a swash ring and rotor assembly generally referenced at 300 is shown. As in the above described embodiments, assembly 300 has a drive shaft 302, a swash ring 304 and a rotor 306. Swash ring 304 is supported around driveshaft 302 by a pin 308. Pin 308 has a straight end 310 that is press fitted into a bore 312 in driveshaft 302. Pin 308 also includes a spherical portion 314 opposite straight end 310. Spherical portion 314 is disposed in a bore 316 disposed in swash ring 304. Further, a sleeve 318 is provided that is press fitted into bore 316. Sleeve 318 has mating surfaces 320 that have a similar shape and profile (i.e. spherical) as spherical portion 314. Thus, in operation, swash ring 304 will pivot about spherical portion 314 changing its angle of inclination relative to the driveshaft 302.

Figure 10:
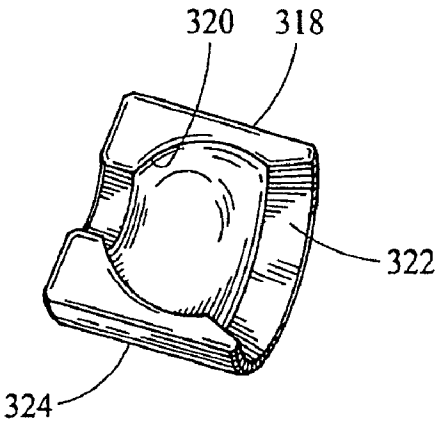
FIG. 10 is a cross-sectional view of a sleeve that distributes the load on the swash ring, in accordance with an alternate embodiment of the present invention.
Figure 11:
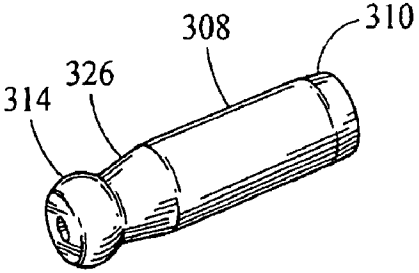
FIG. 11 is a perspective view of the pin that supports the swash ring, in accordance with an alternate embodiment of the present invention.

Referring now to FIGS. 10 and 11, a cross-sectional view of sleeve 318 and a perspective view of pin 308 are shown. Sleeve 318, as referenced above, includes mating surfaces 320 that cooperate with spherical end 314. Additionally, sleeve 318 has a flared end 322 that allows swash ring 304 to change its angle of inclination relative to driveshaft 302 without interfering with pin 308. The outer surface 324 of sleeve 318 cooperates with bore 316 to secure sleeve 318 within bore 316, for example, by press fitting. Pin 308 includes spherical portion 314, as stated above. However, the present invention contemplates that spherical portion 314 need not include the terminal end of pin 308. In other words, spherical portion 314 may be located anywhere along pin 308 to allow swash ring 304 to rotate about spherical portion 314. Adjacent spherical portion 314 is a tapered portion 326 that cooperates with flared end 322 of sleeve 318 to prevent pin 308 from contacting swash ring 304 and sleeve 318 when the swash ring changes its angle of inclination relative to driveshaft 302.

The pin structures described in the various embodiments above allow the load from the swash ring to be distributed over a large area. In a preferred embodiment of the present invention, the swash rings described above are made of soft materials such as aluminum, copper alloys and powder metals. Swash rings made of these soft materials exhibits good bearing properties.

The forgoing description discloses various embodiments, and modifications thereof, of the present invention. One skilled in the art will readily recognize from such disclosure, and from the accompanying drawings and claims, that changes and variations can be made to the invention without departing from the true spirit and fair scope of the invention as defined in the following claims.

What is claimed is:

1. A variable displacement compressor comprising:

a crankcase having a plurality of compression chambers formed therein;

a plurality of pistons, one of the pistons disposed in each of the compression chambers and configured for reciprocal movement therein;

a drive shaft rotatingly disposed in the crankcase;

a swash ring coupled to the pistons to cause a reciprocal motion thereof, an amount of the reciprocal motion adjusted by a tilting of the swash ring; and a pin extending radially outwardly from the drive shaft, a distal end of the pin cooperating with a sleeve having a bore formed therein adapted to receive the pin, the sleeve disposed in an aperture formed in the swash ring to cause a rotational movement of the swash ring and facilitate the tilting thereof, wherein the sleeve is slidably received in the aperture.

2. The compressor according to claim 1, wherein the aperture formed in the swash ring extends in a radial outward direction in respect of the drive shaft.

3. The compressor according to claim 2, wherein the aperture formed in the swash ring extends from an inner surface of the swash ring to an outer surface of the swash ring.

4. The compressor according to claim 1, wherein the pin is disposed at an angle in respect of a direction perpendicular to a longitudinal axis of the drive shaft.

5. The compressor according to claim 1, wherein the pin includes a spherical portion formed on the distal end thereof.

6. The compressor according to claim 5, wherein the spherical portion of the pin is pivotally received in the aperture of the swash ring.

7. A variable displacement compressor comprising:

a crankcase for receiving a fluid and having a plurality of compression chambers formed therein, the fluid compressed within the compression chambers;

a plurality of pistons, one of the pistons disposed in each of the compression chambers and configured for reciprocal movement therein to compress the fluid;

a drive shaft rotatingly disposed in the crankcase, the drive shaft having a constant outer diameter within the crankcase;

a swash ring coupled to the pistons to cause a reciprocal motion thereof, an amount of the reciprocal motion adjusted by a tilting of the swash ring; and a pin extending radially outwardly from the drive shaft, a distal end of the pin cooperating with a sleeve having a bore formed therein, the sleeve disposed in an aperture formed in the swash ring to cause a rotational movement of the swash ring and facilitate the tilting thereof, wherein the sleeve is slidably received in the aperture.

8. The compressor according to claim 7, wherein the aperture formed in the swash ring extends in a radial outward direction in respect of the drive shaft.

9. The compressor according to claim 8, wherein the aperture formed in the swash ring extends from an inner surface of the swash ring to an outer surface of the swash ring.

10. The compressor according to claim 7, wherein the pin is disposed at an angle in respect of a direction perpendicular to a longitudinal axis of the drive shaft.

11. The compressor according to claim 7, wherein the pin includes a spherical portion formed on the distal end thereof.

12. The compressor according to claim 11, wherein the spherical portion of the pin is pivotally received in the aperture of the swash ring.

13. A variable displacement compressor comprising:

a crankcase for receiving a fluid and having a plurality of compression chambers formed therein, the fluid compressed within the compression chambers;

a plurality of pistons, one of the pistons disposed in each of the compression chambers and configured for reciprocal movement therein to compress the fluid;

a drive shaft rotatingly disposed in the crankcase, the drive shaft having at least one aperture formed therein and a constant outer diameter within the crankcase;

a swash ring coupled to the pistons to cause a reciprocal motion thereof, an amount of the reciprocal motion adjusted by a tilting of the swash ring; and a pin extending radially outwardly from at least one of the apertures formed in the drive shaft, a distal end of the pin having a spherical portion formed thereon to cooperate with a sleeve having a bore formed therein adapted to pivotally receive the spherical portion of the pin, the sleeve disposed in an aperture formed in the swash ring to cause a rotational movement of the swash ring and facilitate the tilting thereof, wherein the sleeve is slidably received in the aperture.

14. The compressor according to claim 13, wherein the aperture formed in the swash ring extends in a radial outward direction in respect of the drive shaft.

15. The compressor according to claim 13, wherein the aperture formed in the swash ring extends from an inner surface of the swash ring to an outer surface of the swash ring.

16. The compressor according to claim 13, wherein the pin is disposed at an angle in respect of a direction perpendicular to a longitudinal axis of the drive shaft.

17. The compressor according to claim 13, wherein the spherical portion of the pin is pivotally received in the aperture of the swash ring.

* * * * *